US009936307B2

(12) United States Patent
Chao et al.

(10) Patent No.: US 9,936,307 B2
(45) Date of Patent: Apr. 3, 2018

(54) HEARING AID COMMUNICATION SYSTEM AND HEARING AID COMMUNICATION METHOD THEREOF

(71) Applicant: Unlimiter MFA Co., Ltd., Eden Island, SC (US)

(72) Inventors: Kuan-Li Chao, Taipei (TW); Kuo-Ping Yang, Taipei (TW)

(73) Assignee: UNLIMITER MFA CO., LTD., Eden Island (SC)

( * ) Notice: Subject to any disclaimer, the term of this patent is extended or adjusted under 35 U.S.C. 154(b) by 0 days.

(21) Appl. No.: 15/080,648

(22) Filed: Mar. 25, 2016

(65) Prior Publication Data

US 2016/0381467 A1 Dec. 29, 2016

(30) Foreign Application Priority Data

Jun. 23, 2015 (TW) ..... 104120162 A
Sep. 21, 2015 (TW) ..... 104131191 A

(51) Int. Cl.
*H04R 29/00* (2006.01)
*H04R 25/00* (2006.01)
*G10L 19/00* (2013.01)

(52) U.S. Cl.
CPC ..... *H04R 25/30* (2013.01); *H04R 25/554* (2013.01); *G10L 19/00* (2013.01); *H04R 2420/05* (2013.01)

(58) Field of Classification Search
CPC .. H04R 25/30; H04R 25/554; H04R 2420/05; G10L 19/00
See application file for complete search history.

(56) References Cited

U.S. PATENT DOCUMENTS 7,415,120 B1 * 8/2008 Vaudrey ..... H03G 3/32 381/109
8,189,835 B2 * 5/2012 Dietz ..... H04R 25/554 381/312
8,194,867 B2 * 6/2012 Park ..... H04N 5/445 381/56
2015/0125013 A1 * 5/2015 Secall ..... G10L 19/167 381/315
2015/0139459 A1 * 5/2015 Olsen ..... H04R 1/1091 381/315

* cited by examiner

*Primary Examiner* — Regina N Holder
(74) *Attorney, Agent, or Firm* — Bacon & Thomas, PLLC

(57) ABSTRACT

A hearing aid communication system and a hearing aid communication method thereof are disclosed. The hearing aid communication method includes the steps of: determining whether a sound-providing apparatus is providing a sound signal; when the sound-providing apparatus is providing a sound signal, establishing a connection with a hearing aid; receiving the sound signal from the sound-providing apparatus for transmission to the hearing aid; and when the sound-providing apparatus stops providing the sound signal, breaking the connection with the hearing aid.

11 Claims, 2 Drawing Sheets

HEARING AID COMMUNICATION SYSTEM AND HEARING AID COMMUNICATION METHOD THEREOF

BACKGROUND OF THE INVENTION

1. Field of the Invention

The present invention relates to a hearing aid communication system and a hearing aid communication method thereof; more particularly, the present invention relates to a hearing aid communication system and a hearing aid communication method thereof for maintaining or breaking a connection automatically.

2. Description of the Related Art

As technology develops, so do aids for disabled persons, such as hearing aids for assisting hearing-impaired persons. In the prior art, a new hearing aid has been developed to reinforce sound signals transmitted using the Bluetooth protocol, whereby the hearing-impaired person can hear sounds from a mobile phone or television directly. However, when the hearing aid for assisting a hearing-impaired person establishes a connection with the sound-providing apparatus, the connection status will be maintained. Even if the sound-providing apparatus does not generate a sound signal, the hearing aid will maintain the connection with the sound-providing apparatus continuously. As a result, the hearing aid will broadcast the sound from the sound-providing apparatus; i.e., silence. It is inconvenient to the hearing-impaired person.

Therefore, it is necessary to invent a new hearing aid communication system and a hearing aid communication method thereof to mitigate and/or obviate the aforementioned problems.

SUMMARY OF THE INVENTION

It is an object of the present invention to provide a hearing aid communication system for maintaining or breaking a connection automatically.

It is another object of the present invention to provide a hearing aid communication method applied to the above-mentioned hearing aid communication system.

To achieve the abovementioned object, the hearing aid communication system of the present invention is used for allowing a hearing aid to receive a sound signal from a sound-providing apparatus. The sound-providing apparatus has a digital signal transmitting port. The hearing aid communication system comprises a digital signal receiving port, a wireless transmission module, a decoding module, and a processing module. The digital signal receiving port is electrically connected to the digital signal transmitting port of the sound-providing apparatus for receiving a sound signal from the sound-providing apparatus. The wireless transmission module connects to the hearing aid via a wireless communication path. The processing module is electrically connected to the digital signal receiving port and the wireless transmission module for determine whether the sound-providing apparatus is providing a sound signal, wherein when the sound-providing apparatus is providing the sound signal, the processing module controls the wireless transmission module to establish a connection with the hearing aid, and when the processing module determines that the sound-providing apparatus has stopped providing a sound signal, the processing module controls the wireless transmission module to break the connection with the hearing aid.

The hearing aid communication method comprises the following steps: determining whether the sound-providing apparatus is providing a sound signal; when the sound-providing apparatus is providing a sound. signal, establishing a connection with the hearing aid; receiving the sound signal from the sound-providing apparatus for transmission to the hearing aid; and when the sound-providing apparatus stops providing a sound signal, breaking the connection with the hearing aid.

Other objects, advantages, and novel features of the invention will become more apparent from the following detailed description when taken in conjunction with the accompanying drawings.

BRIEF DESCRIPTION OF THE DRAWINGS

These and other objects and advantages of the present application will become apparent from the following description of the accompanying drawings, which disclose several embodiments of the present application. It is to be understood that the drawings are to be used for purposes of illustration only, and not as a definition of the invention.

In the drawings, wherein similar reference numerals denote similar elements throughout the several views.

DETAILED DESCRIPTION OF THE PREFERRED EMBODIMENT

These and other objects and advantages of the present invention will become apparent from the following description of the accompanying drawings, which disclose several embodiments of the present invention. It is to be understood that the drawings are to be used for purposes of illustration only, and not as a definition of the invention.

Figure 1:
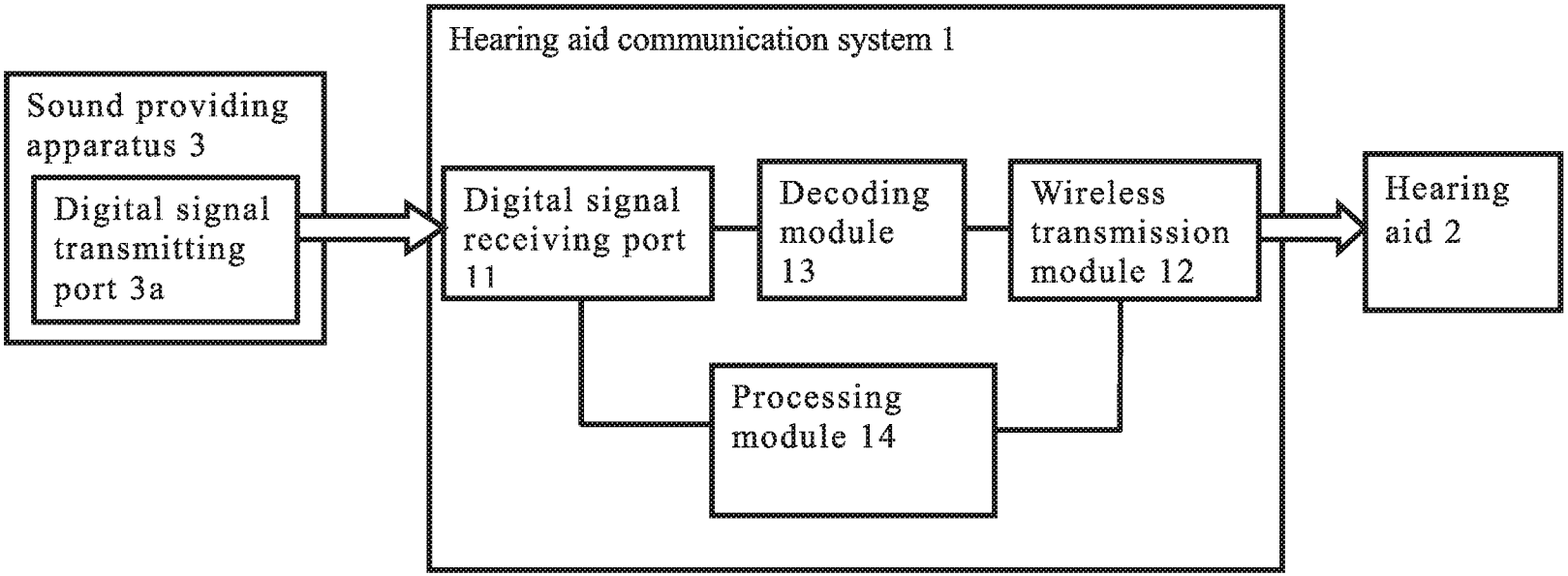
FIG. 1 illustrates a structural drawing of the hearing aid communication system of the present invention.

Please refer to FIG. 1, which illustrates a structural drawing of the hearing aid communication system of the present invention.

The hearing aid communication system 1 of the present invention is used for connecting to a sound-providing apparatus 3 and allowing a hearing aid 2 to receive a sound signal from the sound-providing apparatus 3. The hearing aid 2 can receive an external sound signal and then enlarge and filter the external sound signal for provision to a hearing-impaired person. Because the function of the hearing aid 2 is not the key element of the present invention and has been widely applied by those skilled in the art related to the present invention, there is no need for further description. The sound-providing apparatus 3 can be a television or other audio and video player, but the present invention is not limited to these apparatuses. The sound-providing apparatus 3 has a digital signal transmitting port 3*a* used for transmitting a sound signal with a digital signal format to another external device; e.g., audio equipment.

The hearing aid communication system 1 comprises a digital signal receiving port 11, a wireless transmission module 12, a decoding module 13, and a processing module 14. The digital signal receiving port 11 is electrically connected to the corresponding digital signal transmitting port 3*a* disposed in the sound-providing apparatus 3 to receive a sound signal from the sound-providing apparatus 3. The sound signal is transmitted in a digital format. When the sound-providing apparatus 3 is working normally, the digital sound signal will be transmitted via the digital signal transmitting port 3*a* continuously. The digital signal receiving port 11 and the digital signal transmitting port 3*a* of the sound-providing apparatus 3 can be a S/PDIF (Sony/Philips Digital Interface Format) port which is capable of establishing or breaking the connection automatically when the sound-providing apparatus 3 turns on or turns off. When the S/PDIF port is used, better acoustic fidelity can be generated without setting a best output volume of the sound-providing apparatus 3. But the hearing aid communication system 1 of present invention is not limited to the S/PDIF port. The wireless transmission module 12 has a wireless communication function for connecting to the hearing aid 2 via a wireless communication path, wherein the hearing aid 2 has the same wireless communication function, too. In one embodiment of the present invention, the wireless communication path can be a Bluetooth protocol, but the present invention is not limited to this wireless communication mode.

The decoding module 13 can be a decoding chip and can be electrically connected to the digital signal receiving port 11 for decoding a digital sound signal that has been encoded, encrypted, or compressed into a general uncompressed digital sound signal format. Because the decoding technology is not the key element of the present invention and has been widely applied by those skilled in the art related to the present invention, there is no need for further description. Furthermore, the digital signal receiving port 11 may receive the uncompressed digital sound signal format directly. Thus, in one embodiment of the present invention, the sound signal can be processed without the decoding module 13. The processing module 14 is electrically connected to the digital signal receiving port 11 and the wireless transmission module 12 for determining whether the sound-providing apparatus 3 provides a sound signal. When the sound-providing apparatus 3 is providing a sound signal, the processing module 14 controls the wireless transmission module 12 to establish the connection with the hearing aid 2 so that the decoded sound signal can be transmitted to the hearing aid 2. As a result, the hearing aid 2 can establish a connection with the sound-providing apparatus 3 when the sound-providing apparatus 3 begins providing a sound signal. In addition, when the sound-providing apparatus 3 is providing a sound signal continuously, the processing module 14 controls the wireless transmission module 12 to maintain the connection with the hearing aid 2. Furthermore, when the processing module 14 determines that the sound-providing apparatus 3 is not providing a sound signal, the processing module 14 controls the wireless transmission module 12 to break the connection with the hearing aid 2.

In one embodiment of the present invention, one situation in which the processing module 14 determines the sound-providing apparatus 3 does not provide sound can be that the sound-providing apparatus 3 provides silence. Therefore, when the sound-providing apparatus 3 provides silence for a specific length of time, e.g., 3 seconds or 10 seconds, the processing module 14 controls the wireless transmission module 12 to break the connection with the hearing aid 2. In another embodiment of the present invention, another situation in which the processing module 14 determines that the sound-providing apparatus 3 does not provide a sound signal is that the digital sound signal cannot be received from the sound-providing apparatus 3. In general, the analogue signal cannot distinguish between a silent section of the signal and no signal. However, the digital signal generally has signal flags or package flags at the beginning and end. In addition, a digital signal is usually encrypted or compressed. Therefore, there is a signal even when silence is transmitted. Furthermore, there is also a reference clock when a digital signal is transmitted. If no digital signal is generated, no reference clock will be detected, either. As a result, the present invention can determine whether the sound-providing apparatus 3 is still working according to the digital sound signal. As a result, whether the sound-providing apparatus 3 provides a digital sound signal with sound or one of silence, the hearing aid 2 will maintain the connection. When a short silent signal is received, the hearing aid 2 will not break the connection easily, as the sound-providing apparatus 3 is functioning. On the other hand, when the sound-providing apparatus 3 is not providing a digital sound. signal, the processing module 14 will control the wireless transmission module 12 to break the connection with the hearing aid 2. Please note that the processing module 14 is capable of considering the abovementioned two embodiments: The processing module 14 controls the wireless transmission module 12 to break the connection with the hearing aid 2 when the sound-providing apparatus 3 does not provide a digital sound signal or provides silence for a specific length of time.

It is to be known that the present embodiment is intended to show a preferred embodiment of the present invention. To avoid further description, not all of the possible changes and combinations are described in detail. However, persons of ordinary skill in the art of the present invention may recognize that the abovementioned modules or units may not be necessary. To implement the present invention, the invention may also include other modules or units of the prior art. Each module or unit may be omitted or replaced based on requirements, and other modules or units may be installed between any two modules.

Figure 2:
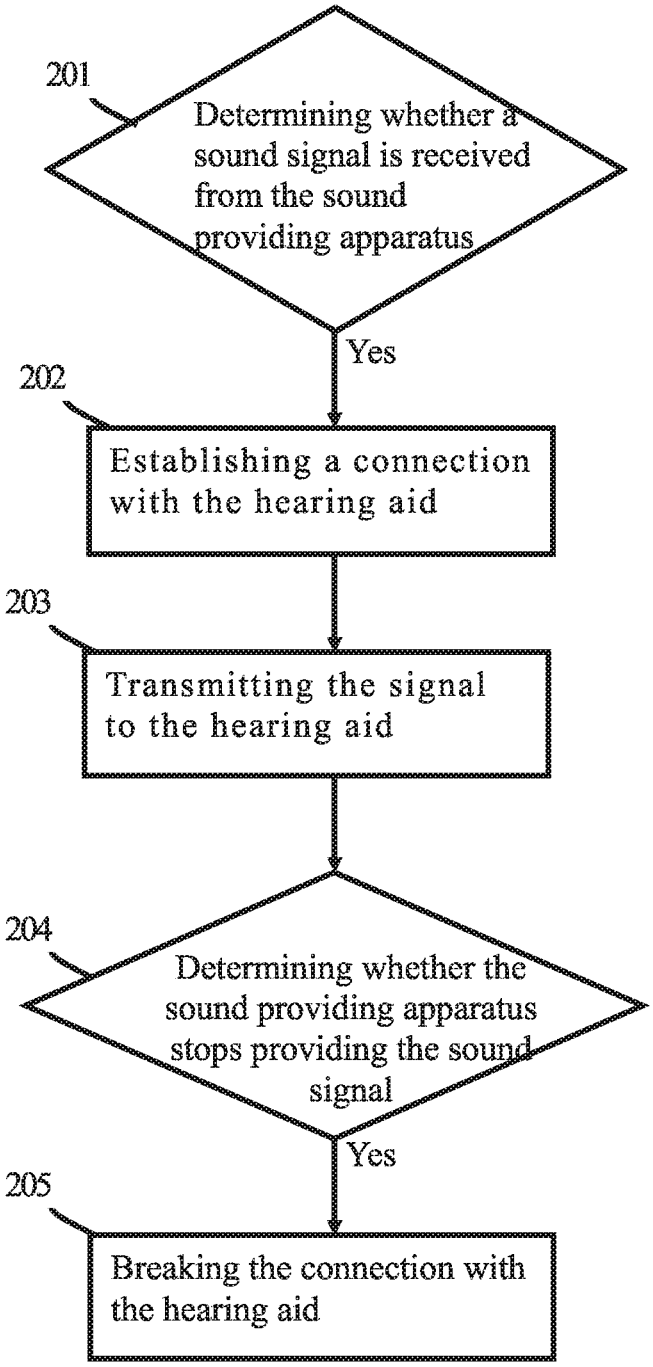
FIG. 2 illustrates a flowchart of the hearing aid communication method of the present invention.

Please refer to FIG. 2, which illustrates a flowchart of the hearing aid communication method of the present invention. It is to be known that, although the following description uses the abovementioned hearing aid communication system 1 to describe the hearing aid communication method of the present invention, the hearing aid communication method of the present invention is not limited to using the same structure as the hearing aid communication system 1.

First, Step 201 is executed: determining whether a sound is received from the sound-providing apparatus.

First, the digital signal receiving port 11 is electrically connected to a corresponding digital signal transmitting port 3*a* of a sound-providing apparatus 3. Thus the processing module 14 is used for determining whether a sound signal is received from the sound-providing apparatus 3.

If the sound-providing apparatus 3 provides a sound signal, then Step 202 is executed: establishing a connection with the hearing aid.

When the sound-providing apparatus 3 is providing a sound signal, the processing module 14 will control the wireless transmission module 12 to establish a connection with the hearing aid 2. Thus the hearing aid 2 can establish a connection with the wireless transmission module 12 to transmit the signal via a wireless communication path; e.g., a Bluetooth protocol.

Then Step 203 is executed: transmitting the sound signal to the hearing aid.

Then the decoding module 13 can decode the encoded, encrypted, or compressed sound signal that is received from the digital signal receiving port 11 into a general uncompressed digital sound signal format. The processing module 14 then transmits the sound signal to the hearing aid 2 via the wireless transmission module 12. Thus, the hearing aid 2 can establish a connection with the sound-providing apparatus 3 immediately when the sound-providing apparatus 3 starts providing a sound signal. In one embodiment of the present invention, when the sound-providing apparatus 3 is providing a digital sound signal continuously, the processing module 14 controls the wireless transmission module 12 to maintain the connection with the hearing aid 2. The processing module 14 does not break the connection arbitrarily.

Then Step 204 is executed: determining whether the sound-providing apparatus has stopped providing a sound signal.

Then the processing module 14 determines whether the sound-providing apparatus 3 has stopped providing a sound signal. For example, when the processing module 14 determines that the sound-providing apparatus 3 has provided silence for a specific length of time or determines that the sound-providing apparatus 3 is not providing a digital sound signal, the processing module 14 will determine that the sound-providing apparatus 3 has stopped providing a sound signal.

Finally, if the processing module 14 determines that the sound-providing apparatus 3 has stopped providing a sound signal in Step 204, then Step 205 is executed: breaking the connection with the hearing aid.

When the processing module 14 determines that the digital sound signal cannot be received from the sound-providing apparatus 3 or the sound-providing apparatus 3 has provided silence for a specific length of time, the processing module 14 controls the wireless transmission module 12 to break the connection with the hearing aid 2. After Step 205, Step 201 can be executed again to allow the processing module 14 to determine whether the sound-providing apparatus 3 is providing a digital sound signal.

It is to be known that the step order of the hearing aid communication method of the present invention is not limited to the abovementioned description and that the abovementioned step order can be changed as long as the object of the present invention can be achieved.

As a result, the present invention allows the hearing-impaired person to hear the sound from the sound-providing apparatus 3 conveniently and maintain the connection with the hearing aid 2. The hearing aid communication system 1 will not arbitrarily determine that the sound-providing apparatus 3 is not functioning and break the connection. with the sound-providing apparatus 3 easily when a silent signal is provided.

It is noted that the above-mentioned embodiments are only for illustration. It is intended that the present invention cover modifications and variations of this invention provided they fall within the scope of the following claims and their equivalents. Therefore, it will be apparent to those skilled in the art that various modifications and variations can be made to the structure of the present invention without departing from the scope of the invention.

What is claimed is:

1. A hearing aid communication system, used for allowing a hearing aid to receive a sound signal from a sound-providing apparatus, wherein the sound-providing apparatus has a digital signal transmitting port, the hearing aid communication system comprising:

a digital signal receiving port, electrically connected to the digital signal transmitting port of the sound-providing apparatus, used for receiving a sound signal from the sound-providing apparatus;

a wireless transmission module, used for connecting to the hearing aid via a wireless communication path; and a processing module, electrically connected to the digital signal receiving port and the wireless transmission module, used for determining whether the sound-providing apparatus is providing the sound signal, wherein when the sound-providing apparatus is providing the sound signal, the processing module controls the wireless transmission module to establish a connection with the hearing aid; when the processing module determines that the hearing aid cannot receive a digital sound signal from the sound-providing apparatus, the processing module controls the wireless transmission module to break the connection with the hearing aid.

2. The hearing aid communication system as claimed in claim 1, wherein when the sound-providing apparatus stops providing a sound signal, the reason is that the sound-providing apparatus provides silence for a specific length of time; thus, the processing module controls the wireless transmission module to break the connection with the hearing aid.

3. The hearing aid communication system as claimed in claim 1, the hearing aid communication system further comprising a decoding module electrically connected to the digital signal receiving port and used for decoding the sound signal into an uncompressed digital sound signal format.

4. The hearing aid communication system as claimed in claim 1, wherein when the sound-providing apparatus is providing the sound signal continuously, the processing module controls the wireless transmission module to maintain the connection with the hearing aid.

5. The hearing aid communication system as claimed in claim 1, wherein the wireless transmission module connects to the hearing aid via a Bluetooth protocol.

6. The hearing aid communication system as claimed in claim 1, wherein the digital signal transmitting port and the digital signal receiving port are S/PDIF ports.

7. A hearing aid communication method, used for allowing a hearing aid to receive a sound signal from a sound-providing apparatus, the method comprising:

determining whether the sound-providing apparatus is providing a sound signal;

when the sound-providing apparatus is providing the digital sound signal, establishing a connection with the hearing aid;

receiving the sound signal from the sound-providing apparatus for transmission to the hearing aid; and when the hearing aid cannot receive a digital sound signal from the sound-providing apparatus, breaking the connection with the hearing aid.

8. The hearing aid communication method as claimed in claim 7, wherein the step of stopping providing the sound signal from the sound-providing apparatus further comprises:

determining that the sound-providing apparatus has provided silence for a specific length of time; and controlling the wireless transmission module to break the connection with the hearing aid.

9. The hearing aid communication method as claimed in claim 7, further comprising a step of decoding the sound signal into an uncompressed digital sound signal format.

10. The hearing aid communication method as claimed in claim 7, further comprising a step of maintaining the connection with the hearing aid when the sound-providing apparatus is providing the sound signal continuously.

11. The hearing aid communication method as claimed in claim 7, further comprising a step of connecting to the hearing aid via a Bluetooth protocol.

* * * * *